US005862765A

United States Patent [19]

Grundl

[11] Patent Number: 5,862,765

[45] Date of Patent: Jan. 26, 1999

[54] CAP SUPPORT FOR AN EMBROIDERY MACHINE

[75] Inventor: Bernard E. Grundl, Costa Mesa, Calif.

[73] Assignee: Data Stitch, Inc., Aledo, Tex.

[21] Appl. No.: 669,989

[22] Filed: Jun. 21, 1996

[51] Int. Cl.[6] ..... D05C 9/04

[52] U.S. Cl. ..... 112/103; 112/470.18

[58] Field of Search ..... 112/103, 470.13, 112/102.5, 63, 470.18

[56] References Cited

U.S. PATENT DOCUMENTS 4,665,844 5/1987 Shibata ..... 112/103
4,998,964 3/1991 Golia ..... 112/103 X
5,501,163 3/1996 Molder et al. ..... 112/470.18 X
5,507,241 4/1996 Evans ..... 112/470.18

*Primary Examiner*—Ismael Izaguirre
*Attorney, Agent, or Firm*—James E. Bradley

[57] ABSTRACT

An embroidery machine has an attachment for stitching hats and caps. The attachment fits over a saddle of the embroidery machine. A cap driver is carried on the saddle. The base of the cap driver moves parallel to the axis of the saddle in unison with a carriage member. The cap driver has an arcuate member which will rotate pivotally relative to the base. A cap retainer releasably fastens to the arcuate member. A guide bar located between the base of the cap driver and the sides of the saddle engages bearings for resisting upward and downward movement of the cap driver relative to the saddle during stitching of the cap.

15 Claims, 4 Drawing Sheets

CAP SUPPORT FOR AN EMBROIDERY MACHINE

BACKGROUND OF THE INVENTION

1. Field of the Invention

This invention relates in general to embroidery machines and in particular to an improved attachment for embroidering hats and caps.

2. Description of the Prior Art

A typical embroidery machine has one or more heads for performing monogramming and making patches. The head is fixed to a frame and is stationary. A saddle extends from the frame outward directly below the head, the saddle containing a bobbin. The head contains needles with different colors of thread for stitching a workpiece located between the saddle and the head.

The workpiece will be moved as the embroidery occurs, with the head and saddle being stationary. The movement of the workpiece is handled by a carriage which moves back and forth parallel to the axis of the saddle in response to commands from a computer. The carriage has a belt that moves directions perpendicular to the carriage in response to commands from the computer. The workpiece will be secured to the belt by an attachment so that it can be moved with the carriage and the belt. One attachment comprises a hoop which is used for making patches and embroidering jackets and other fabrics that can be readily stretched flat within a frame of a hoop. Another attachment is used for embroidering caps, which cannot be readily stretched flat by a hoop. The term "cap" as used herein refers to all headgear on which embroidering is performed, including certain hats.

The cap attachment includes an arm that attaches to the belt and extends forward from the carriage. A cap driver is located over the saddle and is connected by a brace to the carriage. The cap driver is an assembly which includes a base which moves in unison with the carriage. The cap driver also includes an arcuate member which is pivotally rotatable relative to the carriage about an axis parallel to the saddle axis. A linkage member connects between the arm, which is attached to the belt, and the arcuate member. Movement of the belt perpendicular to the saddle axis causes the arcuate member to pivot rotatably about an axis parallel to the saddle axis.

A cap is clamped into a cap retainer and releasably fastened to the arcuate member of the driver. The cap retainer is a metal framework that fits over the free end of the saddle. The framework of the retainer positions a forward portion of the body of the cap in an arcuate position over the saddle. The carriage and belt move the cap driver and cap retainer to embroider the forward portion of the body of the cap.

While this type of attachment is workable, the passage of the needles into and out of the cap fabric creates upward and downward forces on the cap retainer. The cap driver is connected to the machine only by a cantilevered brace to the carriage and thus is unable to completely restrain the cap retainer from all upward and downward movement. The upward and downward movement tends to make it more difficult to achieve preciseness in the embroidery work.

SUMMARY OF THE INVENTION

In this invention, a guide means is located between the base of the cap driver and the saddle for resisting upward and downward movement of the cap retainer relative to the saddle during embroidering of the cap. The guide means in the preferred embodiment includes a guide bar located at each side of the saddle, the guide bar having an upper surface and a lower surface. A set of upper and lower bearings are mounted at each side of the saddle with one of the guide bars located between. The upper bearings engage the upper surface of the guide bar and the lower bearings engage the lower surface of the guide bar. The guide bars are mounted selectively either to the saddle or to the base, while the bearings are mounted to the other side of the saddle or cap driver base. The upper and lower bearings substantially resist all upward and downward movement but allow relative movement of the saddle and cap driver base along the saddle axis.

Preferably, the guide bars are mounted on a sidewall on each side of the saddle, and the bearings are mounted to the base of the cap driver. The bearings are preferably rollers which will engage the guide bars in rolling contact. In one embodiment, the sidewall on each side of the saddle is part of a downward facing channel member that is secured to and forms the sides and upper surface of the saddle. In another embodiment, the sidewalls are part of an upward facing channel member that secures to the saddle. The sidewalls in this second embodiment are spaced laterally outward from and parallel to the sides of the saddle.

DETAILED DESCRIPTION OF THE INVENTION

Figure 1:
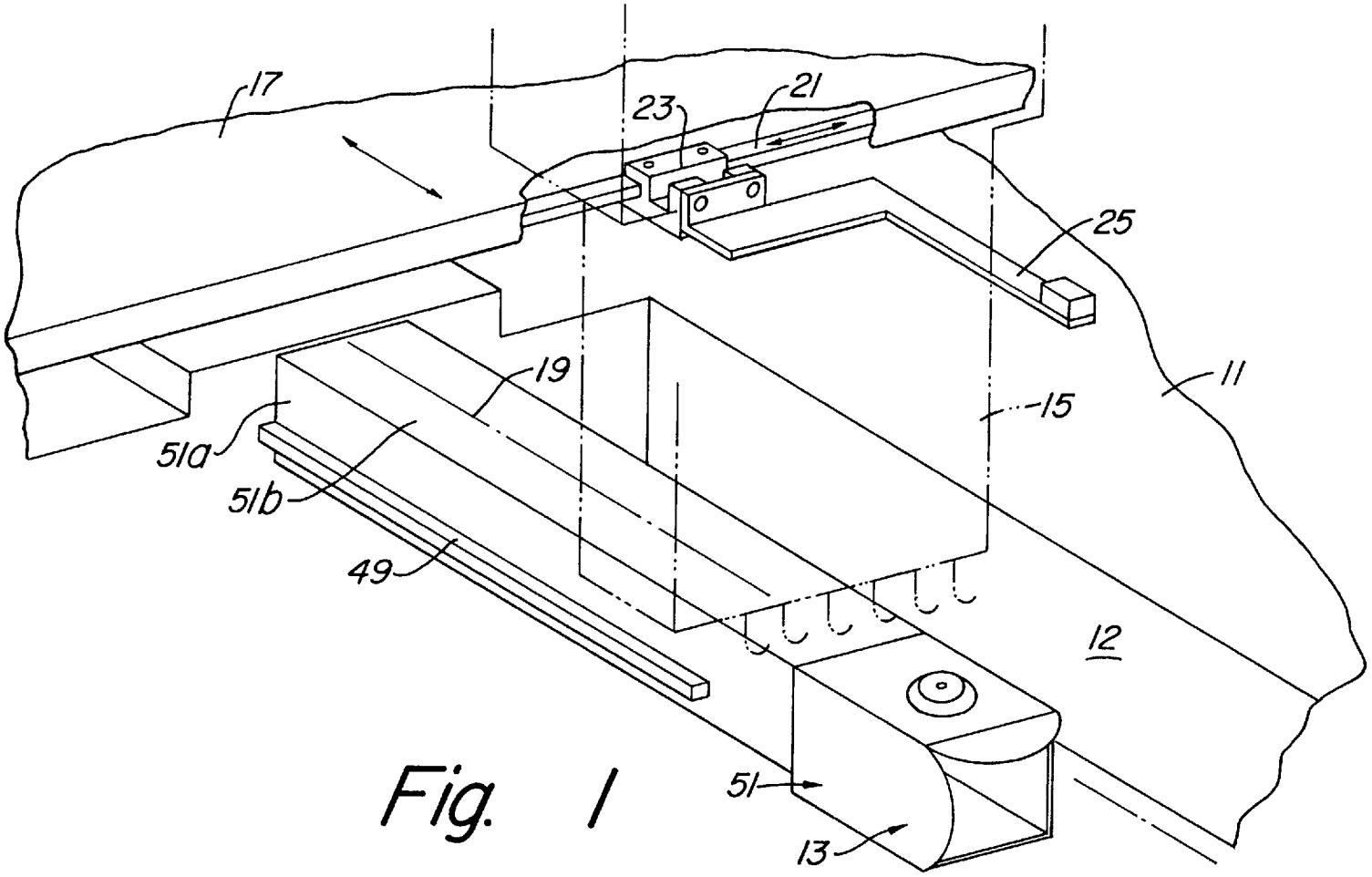
FIG. 1 is a partial perspective view of a part of an embroidery machine, showing a saddle having guide bars in accordance with this invention.

Referring to FIG. 1, the embroidery machine shown has a frame or table 11 which has a central rectangular cavity 12. A saddle 13 extends forward in a candilever manner from table 11. Saddle 13 is surrounded on each side and below by cavity 12. A head 15, shown in phantom, is mounted to table 11 above saddle 13. Head 15 contains needles and different colors of thread for embroidery. A bobbin (not shown) is contained in the free end of saddle 13.

Both saddle 13 and head 15 are stationarily fixed to table 11. The workpiece (not shown) must be moved during the embroidery to form the desired design. This movement is handled by a carriage 17 which is a straight bar that extends across table 11 perpendicular to the axis 19 of saddle 13. Carriage 17 is conventionally mounted on drivers (not shown) which move the carriage 17 forward and backward parallel to saddle axis 19. An endless belt 21 is mounted in carriage 17 and extends perpendicular to saddle axis 19. Belt 21 is driven by rollers which cause movement of belt 21 in directions perpendicular to saddle axis 19, as indicated by the arrows. A computer (not shown) controls the movement of carriage 17 and belt 21 to position the workpiece at the desired locations.

A bracket 23 is rigidly secured to belt 21. An arm 25 secures to bracket 23 and extends forward. The movement of carriage 17 and belt 21 will position arm 25 at desired locations. In one use for the embroidery machine, rather than arm 25, a hoop (not shown) will be attached to bracket 23 for movement with belt 21 and carriage 17. A fabric will be stretched over the hoop.

Figure 2:
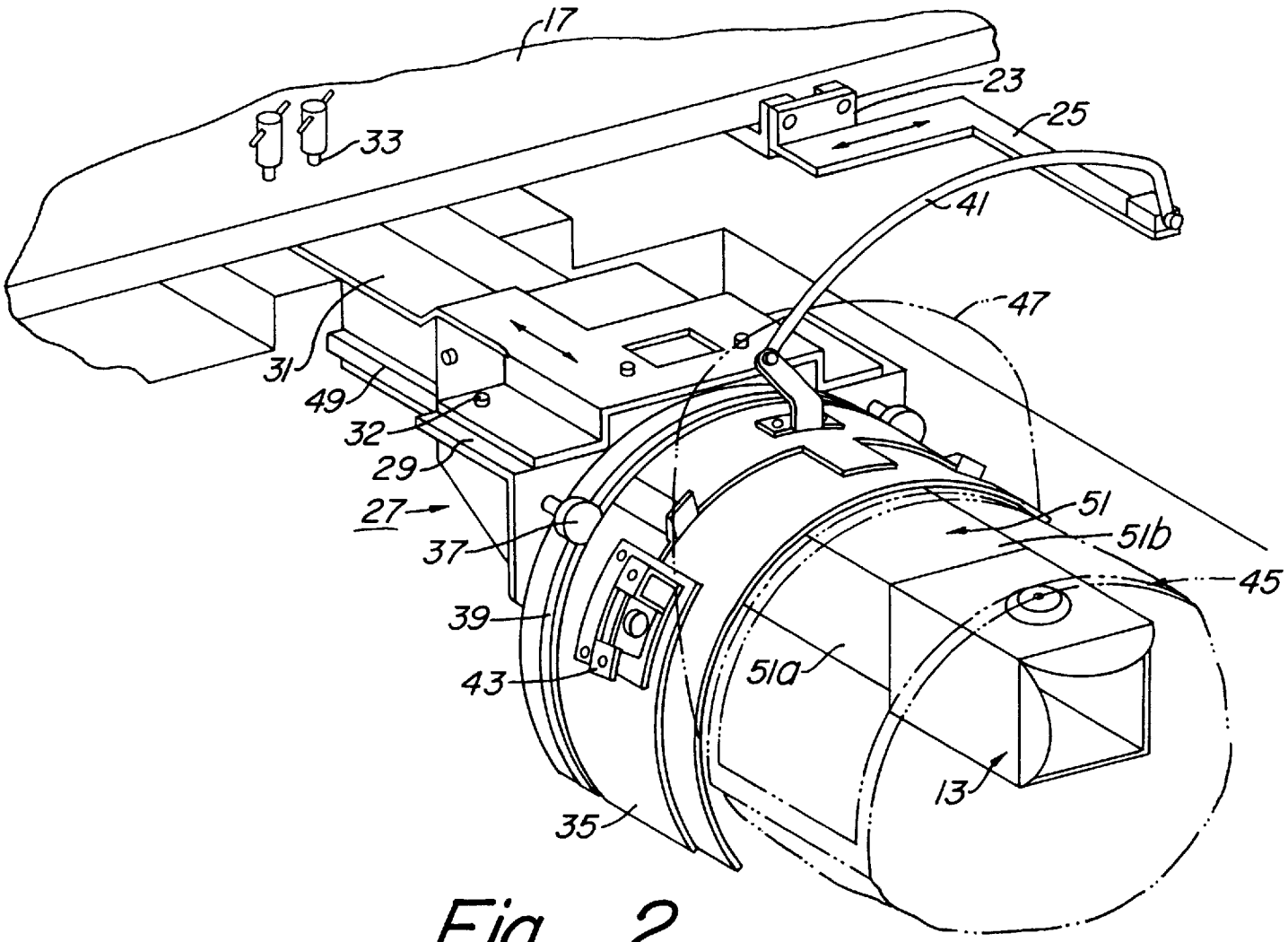
FIG. 2 is another partial perspective view of the embroidery machine of FIG. 1, showing also cap driver constructed in accordance with this invention mounted to the machine.
Figure 3:
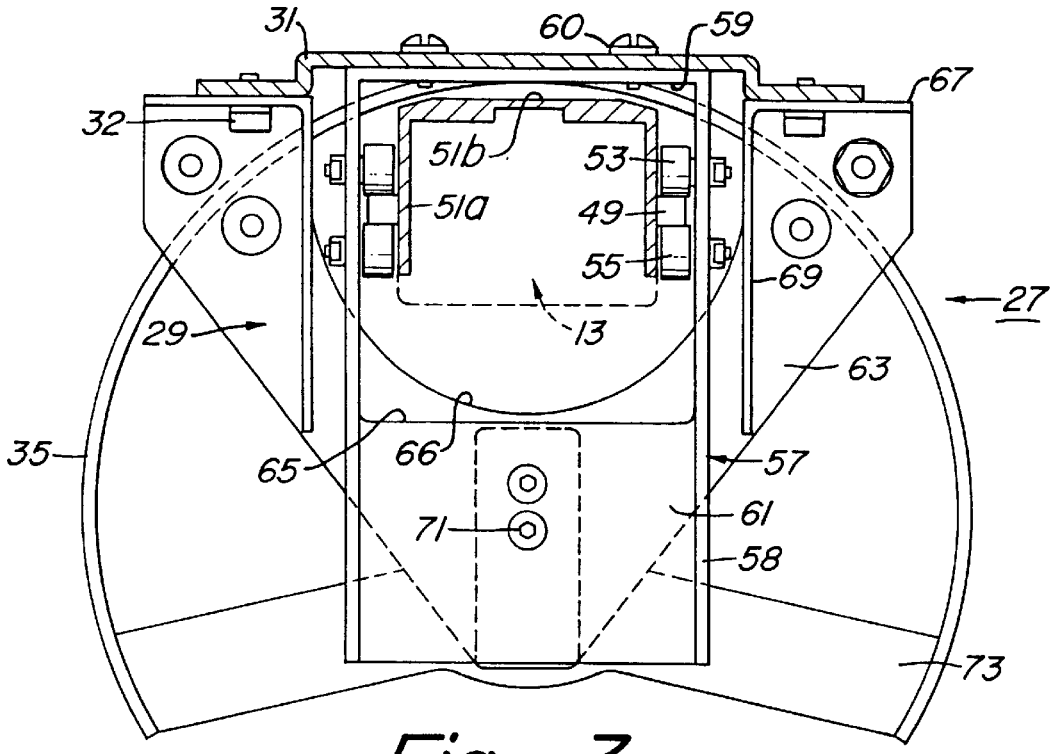
FIG. 3 is a sectional view of the cap driver of FIG. 2, taken along line III—III of FIG. 2.

Referring to FIG. 2, for embroidering caps, a cap driver 27 will be installed over saddle 13 and attached to carriage 17 and arm 25 for movement relative to saddle 13. Cap driver 27 has a base 29, which is also shown in FIG. 3. Base 29 extends over saddle 13 and is secured by a brace 31 to carriage 17. Brace 31 is connected by fasteners 32 to driver 27. Fasteners 33 connect brace 31 to carriage 17. Cap driver 27 will thus move in unison with carriage 17 forward and backward along saddle axis 19.

An arcuate member 35 is rotatably mounted to cap driver base 29 on its forward end. Arcuate member 35 is shown somewhat simplified in the figures, and comprises a semicircular member that extends over saddle 13 and around each side. As shown in FIG. 3, arcuate member 35 extends approximately 240° about an axis parallel with saddle axis 19. Arcuate member 35 will rotate about its axis, which is parallel to saddle axis 19. Guide wheels 37 are fixed to driver base 29 and engage recessed tracks 39 in arcuate member 35. Guide wheels 37 and recesses 39 facilitate rotation of arcuate member 35 relative to base 29 in a plane perpendicular to saddle axis 19. A pivotal linkage bar 41 secures to arm 25 and pivotally secures to arcuate member 35. Movement of arm 25 perpendicular to saddle axis 19 causes rotational movement of arcuate member 35 relative to cap driver 27.

A pair of fasteners 43 are mounted to arcuate member 35 on each side. Fasteners 43 releasably secure a cap retainer 45 to arcuate member 35 for movement therewith. Cap retainer 45 is shown in phantom and is of a conventional type. The bill 47 for the cap being embroidered will extend upward forward of pivotal linkage bar 41 when cap retainer 45 is connected. A forward portion of the body of the cap will be tightly held by cap retainer 45 in an arcuate shape below head 15 (FIG. 1).

Referring also to FIG. 1, a guide bar 49 is secured to each sidewall 51*a* of a downward facing channel member 51. Channel member 51 has an upper surface 51*b* and is secured to saddle 13, forming a part of the upper surface and sides of saddle 13. Each guide bar 49 protrudes outward and has an upper and a lower surface. Each guide bar 49 is a rectangular member that extends a substantial distance along saddle 13 parallel with saddle axis 19.

Figure 4:
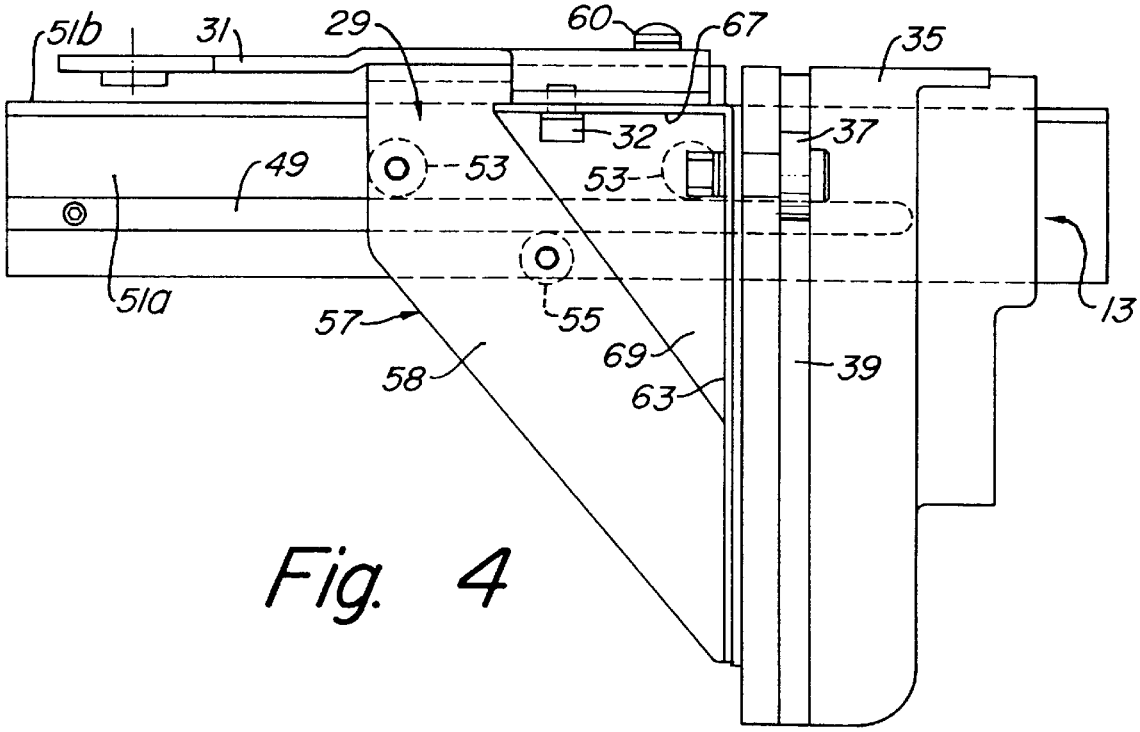
FIG. 4 is a side elevational view of the cap driver shown in FIG. 3.

Referring to FIGS. 3 and 4, two sets of upper bearings or rollers 53 will engage the upper surface of each guide bar 49 in rolling contact. One set of lower bearings or rollers 55 locates below each guide bar 49 and engages the lower surface of each guide bar 49 in rolling contact. The engagement of rollers 53, 55 with guide bars 49 allows cap driver 27 to freely roll along saddle axis 19. However, rollers 53, 55 prevent any upward and downward movement of cap driver 27 relative to saddle 13.

As shown in FIG. 3, in the preferred embodiment, each set of rollers 53, 55 is rotatably mounted to a support member 57 which is a rigidly connected part of cap driver base 29. Support member 57 has two parallel side gussets 58, a horizontal plate 59, and a vertical plate 61 which is perpendicular to gussets 58 and horizontal plate 59. Horizontal plate 59 secures by fasteners 60 to brace 31. Vertical plate 61 is located below horizontal plate 59 and is secured to a vertical plate 63 of driver base 29. The support member vertical plate 61 is separated from horizontal plate 59 by an aperture 65 through which saddle 13 passes. Base vetical plate 63 is generally triangular shaped and contains an aperture 66 through which saddle 13 passes. The upper and lower rollers 53, 55 are mounted to each of the side gussets 58.

Driver base 29 also includes a pair of upper flanges 67 located at the upper edges of the base vertical plate 63. Fasteners 32 extend through flanges 67 to fasten brace 31 to upper flanges 67 of base 29. Base 29 of cap driver 27 also includes a pair of outer gussets 69, each being a triangular plate located outward of one of the support member gussets 58. Outer gussets 69 connect flanges 67 to base vertical plate 63 to provide additional rigidity. A pivot pin 71 extends through base vertical plate 63 and into a hub of arcuate member 35, forming the axis of rotation for arcuate member 35. The hub is supported by two radial braces 73.

In the operation of the embodiment of FIGS. 2–4, normally a conventional channel member (not shown) will be on saddle 13 when using the embroidery machine for applications other than embroidering caps. The conventional channel member has the same configuration as channel member 51 but lacks guide bars 49. Guide bars 49 may interfere with the platform (not shown) normally placed on table 11 when using the machine for hoop applications. Consequently, when beginning to embroider caps, the operator replaces the conventional channel member with channel member 51. The operator then attaches cap driver 27 by securing brace 31 to carriage 17. Arm 25 will normally be previously attached to linkage bar 41 as an assembly. Arm 25, along with linkage bar 41, will be secured to bracket 23. Rollers 53, 55 will engage the upper and lower surfaces of guide bars 49. The user secures a cap to cap retainer 45 and fastens cap retainer 45 to arcuate member 35 with fasteners 43, then embroiders the desired design. Rollers 53, 55, in cooperation with guide bars 49, resist upward and downward movement of cap driver 27 during the embroidering.

Figure 5:
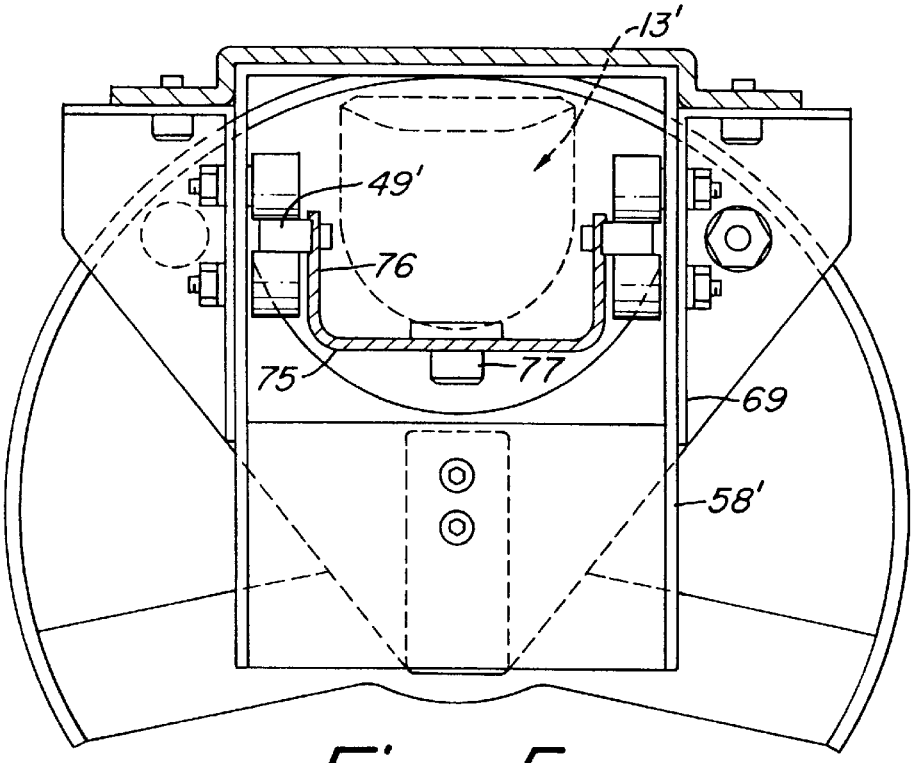
FIG. 5 is a sectional view similar to FIG. 3, but showing an alternate embodiment of the cap driver.
Figure 6:
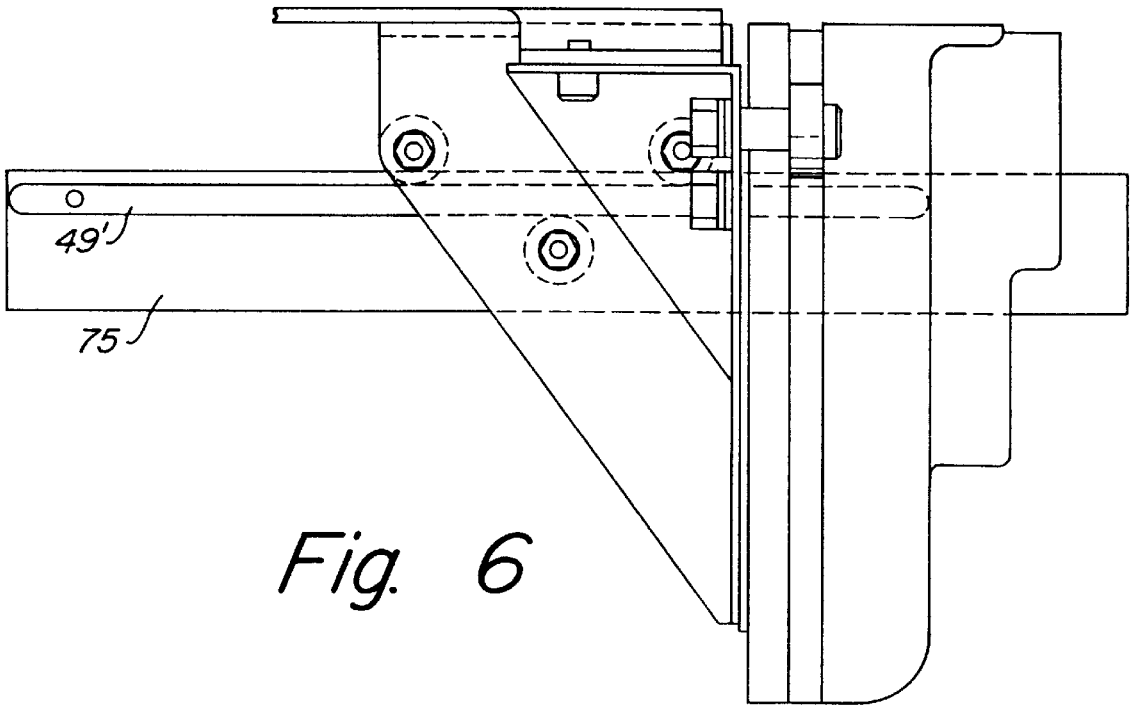
FIG. 6 is a side elevational view of the cap driver of FIG. 5.

FIGS. 5 and 6 show an alternate embodiment. Most of the components are the same as in the first embodiment and for convenience may be shown with the same numeral and a prime symbol. The conventional channel member on saddle 13' is not changed when attaching the cap driver in the second embodiment. Rather, an inverted channel member 75 is fastened to the lower side of saddle 13' when cap embroidery is to be performed. Channel member 75 has a lower surface and two upward extending sidewalls 76. Channel member 75 is secured to the lower surface of saddle 13' by fasteners 77. The sidewalls 76 of channel member 75 extend parallel to and along each sidewall of the conventional channel member of saddle 13'. Guide bars 49' are mounted to the sidewalls 76 of channel member 75. Gussets 58' are spaced wider apart than gussets 58 of the first embodiment and about outer gussets 69'. The remaining components are the same, and the operation is the same.

The invention has significant advantages. The guide bars and rollers provide substantial resistance to upward and downward movement, steadying the cap driver during embroidery operations. The additional components do not increase the time for assemblying the cap driver significantly. The guide bars and rollers may be retrofitted to existing equipment.

While the invention has been shown in only two of its forms, it should be apparent to those skilled in the art that it is not so limited but is susceptible to various changes without departing from the scope of the invention. For example, the rollers could be mounted to the saddle and the guide bars to the cap driver.

I claim:

1. In an embroidery machine having a frame, a saddle fixed to the frame and having a saddle axis and two sides parallel to the saddle axis, a needle head located above the saddle for stitching, a carriage mounted to the frame for movement relative to the frame along the saddle axis, and a drive belt mounted to the carriage for movement relative to the carriage perpendicular to the saddle axis, an improved means for embroidering a cap mounted to a cap retainer, comprising in combination:

a cap driver carried on the saddle, the cap driver having a base and an arcuate member which is mounted to the base for pivotal rotational movement relative to the base about an axis parallel to the saddle axis, the arcuate member extending over and partially around the saddle;

fastening means on the arcuate member for releasably coupling the cap retainer to the arcuate member;

pivotal linkage means connected from the belt to the arcuate member for causing pivotal rotational movement of the arcuate member in response to movement of the belt due to commands provided to the machine;

a brace extending between the carriage and the base of the cap driver for moving the cap driver with the carriage relative to the saddle along the saddle axis in response to commands provided to the machine; and guide means located between the base of the cap driver and the sides of the saddle for preventing upward and downward movement of the cap driver relative to the saddle but allowing axial movement of the cap driver along the saddle axis.

2. The embroidery machine according to claim 1, wherein the guide means comprises:

a guide bar at each of the sides of the saddle, having an upper surface and a lower surface; and a set of upper and lower bearings at each of the sides of the saddle, with one of the guide bars located between, the upper bearings engaging the upper surfaces of the guide bars and the lower bearings engaging the lower surfaces of the guide bars; and wherein the guide bars are mounted selectively to one of the saddles and the base, and the upper and lower bearings are mounted selectively to the other side of the saddle and the base for movement relative to each other along the saddle axis.

3. The embroidery machine according to claim 1, wherein the guide means comprises:

a guide bar carried by the saddle at each of the sides of the saddle, each of the guide bars having an upper surface and a lower surface; and a set of upper and lower roller bearings mounted to the base next to each of the sides of the saddle, with one of the guide bars located between, the upper roller bearings engaging the upper surfaces of the guide bars in rolling contact and the lower roller bearings engaging the lower surfaces of the guide bars in rolling contact.

4. The embroidery machine according to claim 1, wherein:

the saddle has a downward facing channel member mounted thereon which has an upper surface and two sidewalls, each of the sidewalls forming one of the sides of the saddle; and the guide means comprises:

a guide bar stationarily mounted on each sidewall of the channel member, having an upper surface and a lower surface; and a set of upper and lower bearings mounted to the base laterally outward of each of the sidewalls of the channel member, with one of the guide bars located between for relative movement, the upper bearings engaging the upper surfaces of the guide bars and the lower bearings engaging the lower surfaces of the guide bars.

5. The embroidery machine according to claim 1, wherein the guide means comprises:

a guide bar at each of the sides of the saddle, having an upper surface and a lower surface; and at least two upper bearings and one lower bearing located at each of the sides of the saddle, with one of the guide bars located between, the upper bearings at each of the sides of the saddle being spaced apart along the saddle axis and engaging the upper surfaces of the guide bars, the lower bearings engaging the lower surfaces of the guide bars; and wherein the guide bars are mounted selectively to one of the saddles and the base and the upper and lower bearings are mounted selectively to the other of the saddle and the base for movement relative to each other along the saddle axis.

6. The embroidery machine according to claim 1, wherein the guide means comprises:

a guide channel member having a lower surface and upward extending sidewalls;

mounting means for stationarily mounting the guide channel member to the saddle with the lower surface below the saddle and the sidewalls of the channel member extending alongside and laterally outward of the sides of the saddle;

a guide bar stationarily mounted to each sidewall of the guide channel member, having an upper surface and a lower surface; and a set of upper and lower bearings mounted to the base next to each of the sidewalls of the guide channel member, with one of the guide bars on each of the sidewalls located between the upper and lower bearings for relative movement, the upper bearings engaging the upper surfaces of the guide bars and the lower bearings engaging the lower surfaces of the guide bars.

7. In an embroidery machine having a frame, a saddle fixed to the frame and having a saddle axis and two sides parallel to the saddle axis, a needle head located above the saddle for stitching, a carriage mounted to the frame for movement relative to the frame along the saddle axis, and a drive belt mounted to the carriage for movement relative to the carriage along a belt axis which is perpendicular to the saddle axis, an improved means for embroidering a cap mounted to a cap retainer, comprising in combination:

a cap driver, movably carried on the saddle, the cap driver having a base and an arcuate member which is mounted to the base for pivotal rotational movement relative to the base about an axis parallel to the saddle axis, the arcuate member extending partially around the saddle;

fastening means on the arcuate member for releasably coupling the cap retainer to the arcuate member for movement therewith;

pivotal linkage means connected from the belt to the arcuate member for causing pivotal rotational movement of the arcuate member relative to the base in response to movement of the belt along the belt axis due to commands provided to the machine;

a brace extending between the carriage and the base of the cap driver for moving the cap driver with the carriage relative to the saddle along the saddle axis in response to commands provided to the machine;

upper and lower bearings at each of the sides of the saddle between the base of the cap driver and one of the sides of the saddle; and a pair of guide bars, one at each of the sides of the saddle between the base of the cap driver and one of the sides of the saddle and located between the upper and lower bearings, the bearings and the guide bars being movable relative to each other along the saddle axis, but preventing upward and downward movement of the cap driver relative to the saddle during stitching of the cap.

8. The embroidery machine according to claim 7, wherein:

the guide bars are stationarily mounted to the saddle, and the upper and lower bearings are mounted to the base of the cap driver for movement with the cap driver along the saddle axis.

9. The embroidery machine according to claim 7, wherein:

the saddle has a downward facing channel member mounted thereon which has an upper surface and two sidewalls, each of the sidewalls forming one of the sides of the saddle;

the guide bars are stationarily mounted to the sidewalls of the saddle; and the upper and lower bearings are mounted to the base of the cap driver for movement with the cap driver along the saddle axis.

10. The embroidery machine according to claim 7, further comprising:

a guide channel member having a lower surface and upward extending sidewalls;

mounting means for stationarily mounting the channel member to the saddle with the lower surface of the channel member below the saddle and the sidewalls extending alongside and outward of the sides of the saddle relative to the saddle axis; and wherein one of the guide bars is stationarily mounted to each sidewall of the guide channel member; and the upper and lower bearings are mounted to the base.

11. The embroidery machine according to claim 7, wherein the base comprises:

a horizontal plate which secures to the brace;

a vertical plate extending downward from the horizontal plate and having an aperture for receiving the saddle, wherein the arcuate member is pivotally mounted to the vertical plate;

a pair of gusset braces extending between the horizontal plate and the vertical plate along each sidewall of the saddle;

wherein the bearings are mounted to the gusset braces; and the guide bars are stationarily carried by the saddle.

12. In an embroidery machine having a frame, a saddle fixed to the frame, having two parallel sides separated by a saddle axis which is parallel to the sides, a needle head located above the saddle for stitching, a carriage mounted to the frame for movement relative to the frame along the saddle axis, and a drive belt mounted to the carriage for movement relative to the carriage along a belt axis which is perpendicular to the saddle axis, an improved means for embroidering a cap mounted to a cap retainer, comprising in combination:

a driver base having a horizontal plate which locates above the saddle, a vertical plate extending downward from the horizontal plate, the vertical plate having an aperture for receiving the saddle, and a pair of gusset braces extending between the vertical plate and the horizontal plate parallel to and adjacent to each of the sides of the saddle;

an arcuate member which is pivotally mounted to the vertical plate of the base for pivotal rotational movement relative to the base about an axis parallel to the saddle axis, the arcuate member extending partially around the saddle;

fastening means on the arcuate member for releasably coupling the cap retainer to the arcuate member for movement therewith;

pivotal linkage means connected from the belt to the arcuate member for causing pivotal rotational movement of the arcuate member in response to movement of the belt along the belt axis due to commands provided to the machine;

a brace extending between the carriage and the base of the cap driver for moving the cap driver with the carriage relative to the saddle along the saddle axis in response to commands provided to the machine;

upper and lower bearings mounted to each of the gusset braces; and a pair of guide bars carried stationarily by the sadde, one at each side of the saddle between the upper and lower bearings, the bearings allowing movement of the base along the saddle axis, but preventing upward and downward movement of the base and arcuate member relative to the saddle during stitching of the cap.

13. The embroidery machine according to claim 12 wherein the upper and lower bearings comprises rollers which engage the guide bars in rolling contact.

14. The embroidery machine according to claim 12 wherein the guide bars are mounted to the sides of the saddle.

15. The embroidery machine according to claim 12, further comprising:

a guide channel member having a lower surface and upward extending sidewalls;

mounting means for stationarily mounting the guide channel member to the saddle with the lower surface of the guide channel member below the saddle and the sidewalls extending alongside and outward of the sides of the saddle relative to the saddle axis; and wherein one of the guide bars is stationarily mounted to each sidewall of the guide channel member.

* * * * *